US005751414A

United States Patent [19]

Nishishita

[11] Patent Number: 5,751,414

[45] Date of Patent: May 12, 1998

[54] LAMINATED HEAT EXCHANGER

[75] Inventor: Kunihiko Nishishita, Konan, Japan

[73] Assignee: Zexel Corporation, Tokyo, Japan

[21] Appl. No.: 755,830

[22] Filed: Nov. 26, 1996

[30] Foreign Application Priority Data

Nov. 30, 1995 [JP] Japan ..... 7-335948

[51] Int. Cl.[6] ..... G01N 21/00

[52] U.S. Cl. ..... 356/237; 165/153

[58] Field of Search ..... 356/237; 165/153

[56] References Cited

U.S. PATENT DOCUMENTS

| | | | |
|---|---|---|---|
| 4,800,954 | 1/1989 | Noguchi | 165/153 |
| 5,332,032 | 7/1994 | Beddome et al. | 165/153 |
| 5,553,664 | 9/1996 | Nishishita | 165/153 |

*Primary Examiner*—David C. Nelms

*Assistant Examiner*—Reginald A. Ratliff

*Attorney, Agent, or Firm*—Wenderoth, Lind & Ponack

[57] ABSTRACT

In a laminated heat exchanger provided with tanks only on one side, which is constituted by laminating tube elements alternately with fins over a plurality of levels, a flange portion projecting out toward the fins is provided in each formed plate constituting the tube elements at an end portion on the opposite side from the tanks, and the flange portions facing opposite each other between the individual tube elements are made to face opposite each other over gaps. A notch is formed in each flange portion. For different types of formed plates, the notches are at positions shifted relative to one another in the direction of the width of the core main body along the direction of airflow. A notch may be formed at any position and be of any size in the flange portion. When assembling different types of tube elements, even if there are many different types of tube elements, the likelihood of erroneous assembly is reduced and, moreover, the likelihood of erroneous judgment through visual inspection or the use of a detection device can be reduced.

18 Claims, 13 Drawing Sheets

LAMINATED HEAT EXCHANGER

BACKGROUND OF THE INVENTION

1. Field of the Invention

The present invention relates to a laminated heat exchanger employed in an air conditioning system for vehicles, an air conditioning system for residential buildings and the like. To be more specific, it relates to a laminated heat exchanger that is constituted by laminating tube elements, each of which is provided with a U-turn passage formed inside it, alternately with fins over a plurality of levels, with tanks provided only on one side.

2. Description of the Related Art

The so-called unilateral-tank type heat exchangers, which are constituted by laminating a plurality of tube elements with tanks provided on one side for distributing and collecting heat exchanging medium flowing through each tube element in the known art include, for instance, the heat exchanger disclosed in Japanese Unexamined Patent Publication No. H3-286997. This heat exchanger is constituted by laminating a plurality of tube elements, each of which is provided with a pair of tank components formed at one end and a U-turn passage portion communicating between the pair of tank components, with their tank components abutted, and by providing fins at the air passages formed between the tube elements. In this heat exchanger, first tube elements, each of which is provided with communicating holes formed at the tank components are combined with blocked-off second tube elements which are not provided with communicating holes at the tank components to cause the heat exchanging medium that has flowed in to pass through the tube elements a plurality of times before it flows out.

The feature that merits particular notice in this laminated heat exchanger is that flange portions that are bent toward the fins are formed on the opposite side from the tanks with drain discharge holes formed at these flange portions. By varying the number of drain discharge holes in the different types of tube elements (first tube elements and second tube elements), verification as to whether or not the tube elements are assembled in the correct order through visual inspection or through the use of a detection device is facilitated.

In the evaporator described above, the drain discharge holes serve as identification marks in the tube elements and in order to assure good water flow, it is desirable to provide large drain discharge holes or to form them at a plurality of locations. In the structural example disclosed in the publication above, at least three drain discharge holes are commonly formed at each flange portion. Thus, in order to ensure that the first tube elements can be distinguished from the second tube elements, new drain discharge holes are added in the remaining area of the flange portion other than the area where the common drain discharge holes are formed. However, since the holes for identification purposes must be formed by using the remaining area, while differentiation may be facilitated as long as there are only two types of tube elements, if there are more types of tube elements to be differentiated, it becomes difficult to secure enough space where identification holes can be added.

In addition, if there are many holes, errors are likely to occur in visual identification. Even when a detection device is employed, there tends to be erroneous judgments made, particularly in the case of a heat exchanger employing the plunger pin method as disclosed in the publication mentioned above.

SUMMARY OF THE INVENTION

Accordingly, an object of the present invention is to provide a laminating heat exchanger that achieves a reduction in erroneous judgments being made during visual inspection or inspection by a detection device even when there are many different types of tube elements used in the assembly of various types of tube elements and, consequently, reduces the likelihood of erroneous assembly.

During the process of developing a next generation of heat exchangers, the applicant of the present invention noted that when producing the two different types of heat exchangers shown in FIGS. 1 and 8 by using as many common parts as possible, several different types of formed plates must be prepared to constitute the tube elements to be placed in the middle of the lamination, that the flange portions provided for preventing fins from falling out during assembly project toward the fins from the end of the formed plates on the side opposite from the tanks in the heat exchanger with the flange portions facing opposite each other over a specific gap without being in contact with each other, so that even when the side opposite from the tanks is placed downward, these gaps will ensure a good drainage, that identification marks can be provided by utilizing the entirety of each flange portion and the like, which has culminated in the present invention.

Thus, in the laminated heat exchanger according to the present invention, a core main body is constituted by laminating tube elements each of which is formed by bonding two formed plates face-to-face, over a plurality of levels with fins provided between the tube elements, a U-turn passage is provided inside each tube element with both ends of the U-turn passage communicating with tanks provided at one end of the core main body, flange portions which project out from the formed plates toward the fins are provided at the other end of the core main body with the flange portions facing opposite each other among the individual tube elements being made to face opposite each other over a gap with notches formed at the flange portions and, in individual types of formed plates, these notches are formed with their positions shifted in the direction of the width of the core main body which extends along the direction of the airflow.

The tanks to be provided at one end of the core main body in this heat exchanger may be formed as an integral parts of the individual tube elements or they may be formed as separate members. If they are formed as integrated parts of the individual tube elements, tank components should be formed at one end of each tube element and adjacent tube elements may be abutted at the tank components so that the tank components can communicate with each other through the tank components.

In addition, the laminated heat exchanger may be of a type with the inflow/outflow ports for the heat exchanging medium formed at the plate at the extreme end in the direction of the lamination or a type with the inflow/outflow ports projecting and opening in the direction of airflow (the direction perpendicular to the direction of the lamination) in the middle of the lamination.

Furthermore, in different types of formed plates, the notches to be formed in the flange portions of the formed plates may have different sizes, which can be achieved by, for instance, varying the width in the direction of airflow.

Consequently, since the flange portions provided at the side opposite from the tanks in the core main body are made to face opposite each other over a specific gap, it is not necessary to assure good drainage by providing holes in the flange portions themselves and it is possible to form notches in arbitrary sizes and at any position in the flange portions in order to identify different types of formed plates, facilitating identification of many different types of formed plates.

BRIEF DESCRIPTION OF THE DRAWINGS

The above and other features of the invention and the concomitant advantages will be better understood and appreciated by persons skilled in the field to which the invention pertains in view of the following description given in conjunction with the drawings which illustrate preferred embodiments. In the drawings.

DETAILED DESCRIPTION OF THE PREFERRED EMBODIMENTS

The following is an explanation of the preferred embodiments of the present invention in reference to the drawings.

Figure 1:
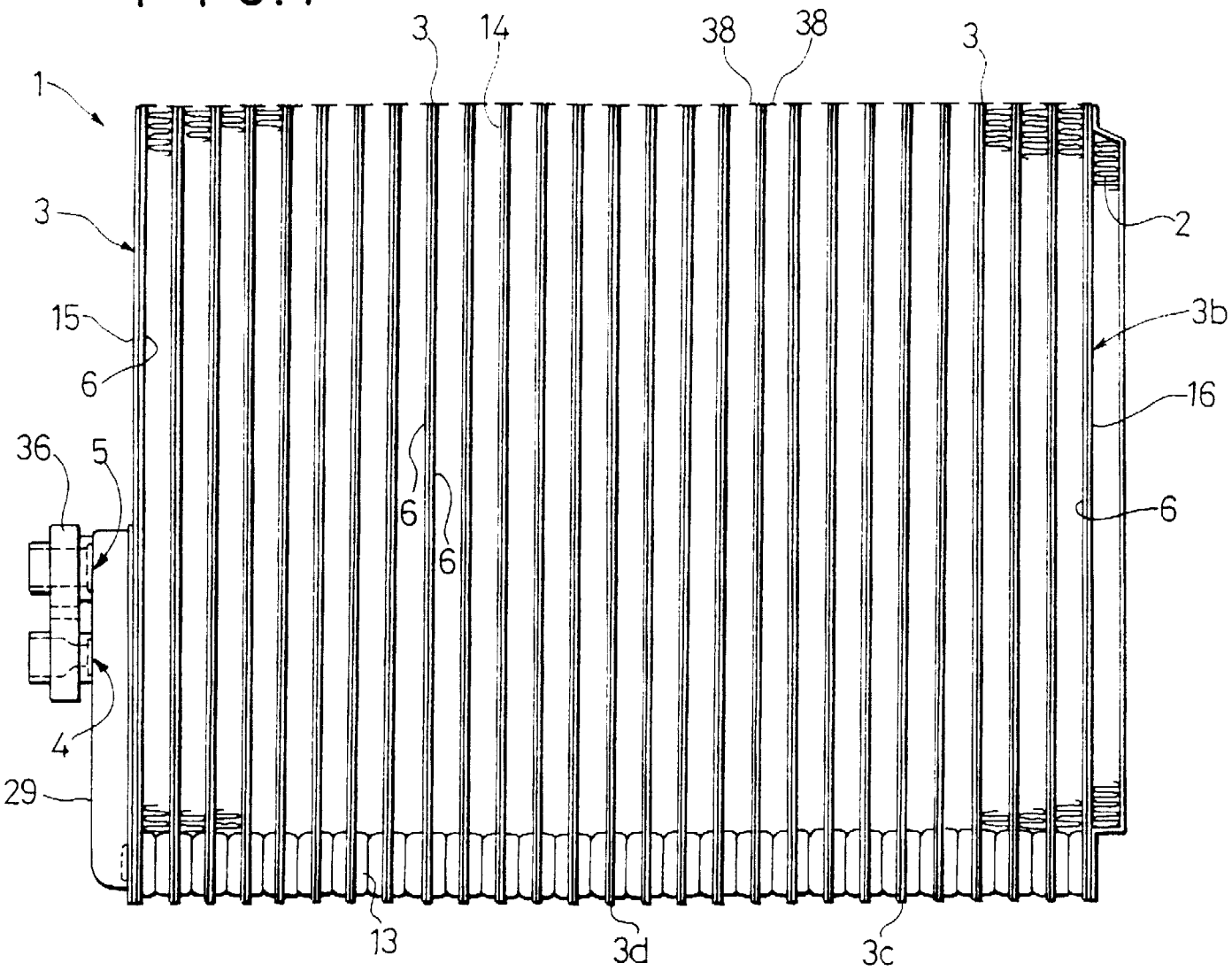
FIG. 1 is a front view of a structural example of a laminated heat exchanger according to the present invention.
Figure 2B:
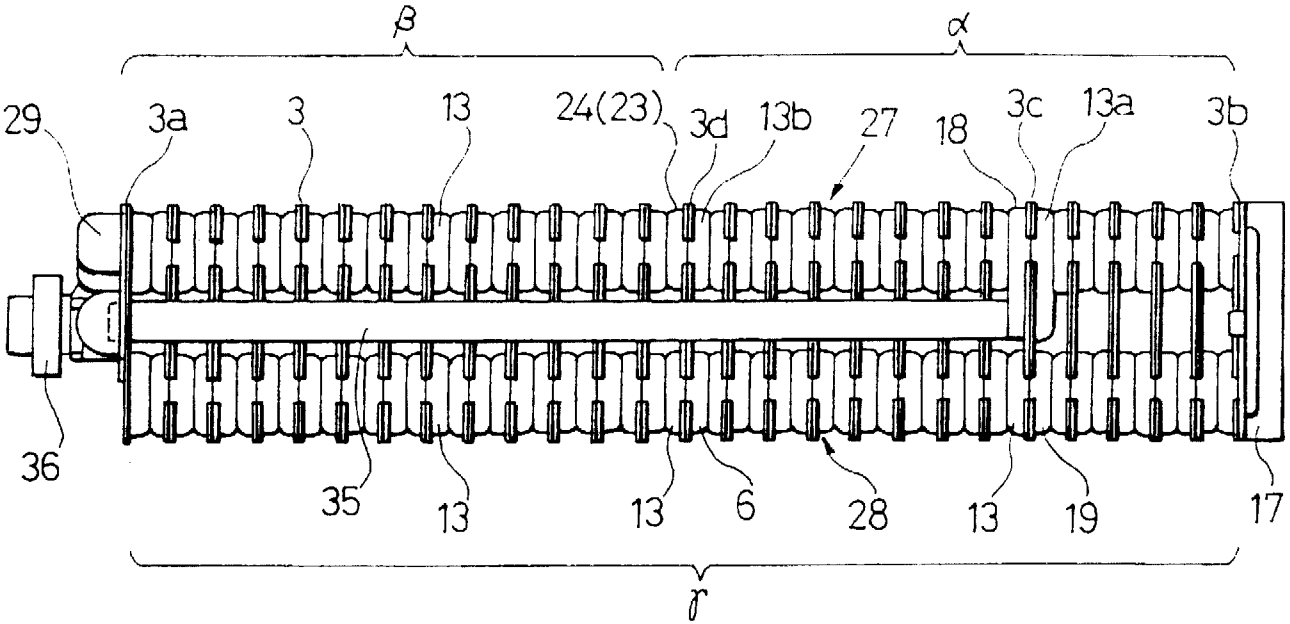
FIG. 2B is the laminated heat exchanger shown in FIG. 1 viewed from the bottom.
Figure 2A:
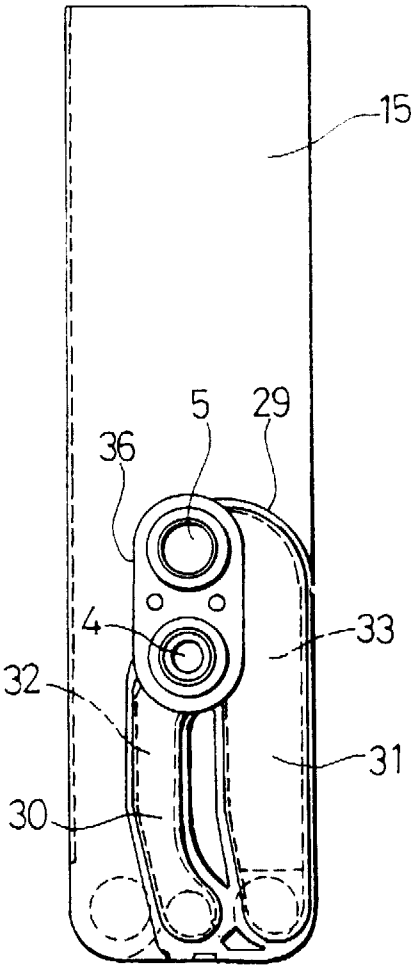
FIG. 2A is the laminated heat exchanger shown in FIG. 1 viewed from the side.

In FIGS. 1 and 2, which show a laminated heat exchanger 1 that is employed in an air conditioning system for vehicles or the like, the laminated heat exchanger 1 may employ, for instance, the 4-pass system with its core main body constituted of fins 2 and tube elements 3 laminated alternately over a plurality of levels and an inflow port 4 and an outflow port 5 for coolant provided at one end in the direction of the lamination of the tube elements 3. Apart from tube elements 3*a* and 3*b* at the two ends of the core main body in the direction of the lamination, a tube element 3*c* that is provided with an enlarged tank component and is to be detailed later and the tube element 3*d*, located at approximately the center, each of the tube elements 3 are constituted by bonding face-to-face two formed plates 6, one of which is shown in FIG. 3.

The formed plate 6, constituted by press machining an aluminum alloy sheet whose main raw material is aluminum and which is clad with brazing material on both surfaces, is provided with two bowl-like distended tank portions 8 and 8 at one end and a distended passage portion 9 continuing from them. Between the distended tank portions, an indented portion 10 for mounting a communicating pipe 35, which is to be detailed later, is formed. In addition, a communicating hole 20 is formed in each distended tank portion 8. In the distended passage portion 9, beads 7, which are arranged with specific regularity, and a partitioning wall 11, which extends from a position between the two distended tank portions for 8 and 8 to the vicinity of the other end of the formed plate 6, are formed.

The distended tank portions 8 are formed to distend farther than the distended passage portion 9 in the direction of the lamination, and the partitioning wall 11 is formed in such a manner that it is on the same plane as a bonding margin 12 at the peripheral edge of the formed plate. As a result, when two formed plates 6 are bonded at their peripheral edges, their partitioning walls 11 also become bonded to each other, so that a pair of tank components 13 and 13 are formed by the distended tank portions 8 which face opposite each other, and a U-turn passage 14 connecting the tank components is formed by the distended passage portions 9 that face opposite each other.

Figure 3A:
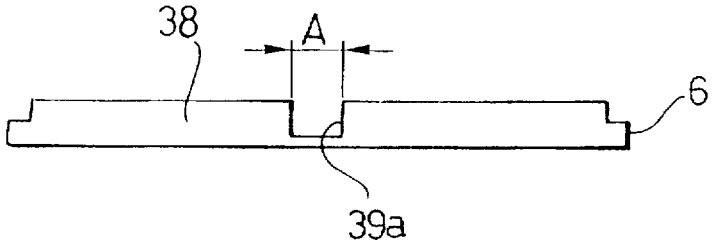
FIG. 3 shows a standard type formed plate employed in the laminated heat exchanger shown in FIG. 1, with FIG. 3A showing the formed plate in FIG. 3B viewed from above and FIG. 3B showing a front view.
Figure 3B:
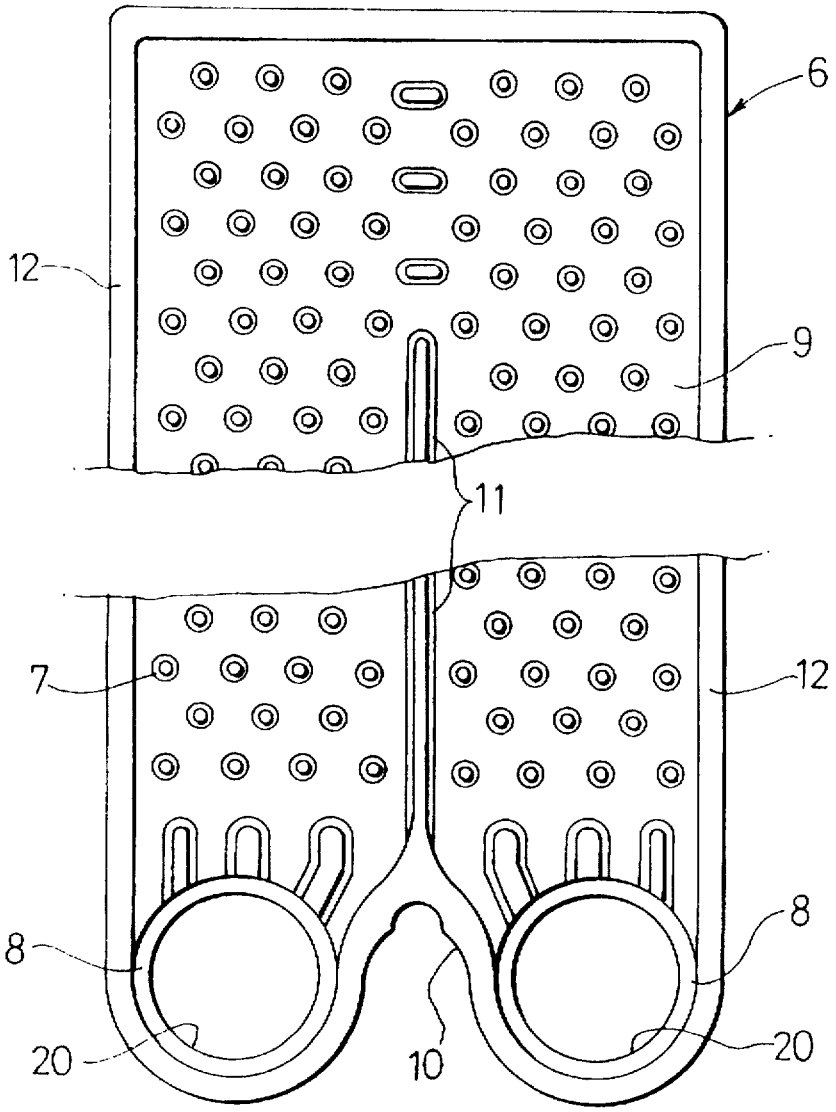

The tube elements 3*a* and 3*b* at the two ends in the direction of the lamination are each respectively constituted by bonding flat plates 15 and 16 (see FIG. 1) to the formed plate 6 shown in FIG. 3, and the flat plate 16 of the tube element 3*b* is further bonded with an end plate 17. In addition, the tube element 3*c* (the tube element at the sixth level counting from the tube element 3*d*) is constituted by bonding face-to-face a formed plate 18, one of whose distended tank portions, i.e., the distended tank portion 8*a*, is formed enlarged so that it approaches the other distended tank portion 8, as shown in FIG. 4, and a formed plate 19 which is formed almost symmetrically to the formed plate 18 as shown in FIG. 5. As a result, the tube element 3*c* is provided with a tank component 13 of same size as that of the tank components formed in other tube elements 3 and a tank component 13*a*, which is enlarged to fill the indented portion. In this tube element 3*c*, too, a communicating hole 20 is formed in each distended tank portion, and a connecting hole 21 for connecting the enlarged distended tank portion 8*a* to a communicating pipe 35 is formed in one of the formed plates, i.e., the formed plate 18 shown in FIG. 4. A curved portion 22 for reducing the force applied by the heat exchanging medium is formed in the area that faces opposite the connecting hole 21 (see FIG. 5).

Figure 6A:
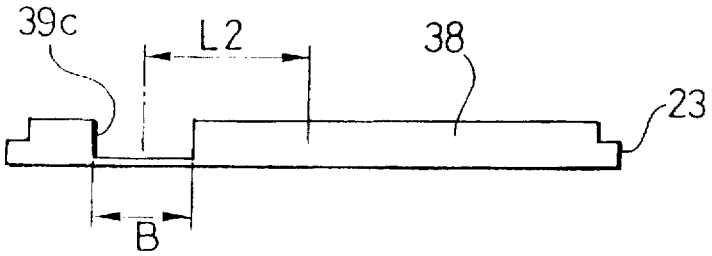
FIG. 6 shows the formed plate in the tube element provided with a blind tank component in the laminated heat exchanger, with FIG. 6A showing the formed plate in FIG. 6B viewed from above and FIG. 6B showing a front view.
Figure 6B:
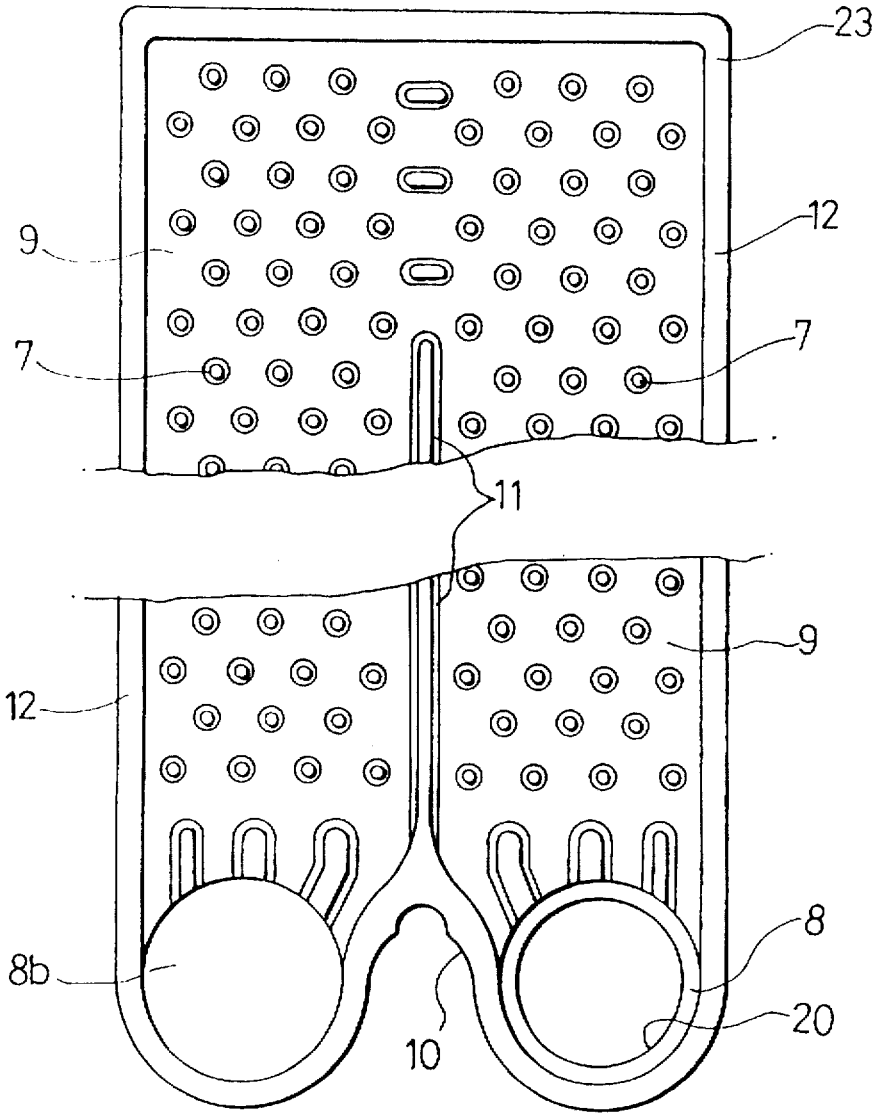
Figure 7A:
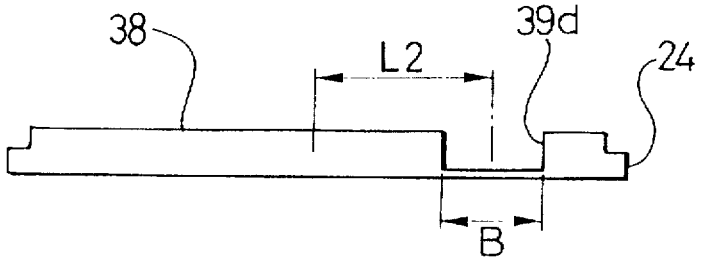
FIG. 7 shows the formed plate in the tube element provided with a blind tank component and a constriction employed in the laminated heat exchanger, with FIG. 7A showing the formed plate in FIG. 7B viewed from above and FIG. 7B showing a front view.
Figure 7B:
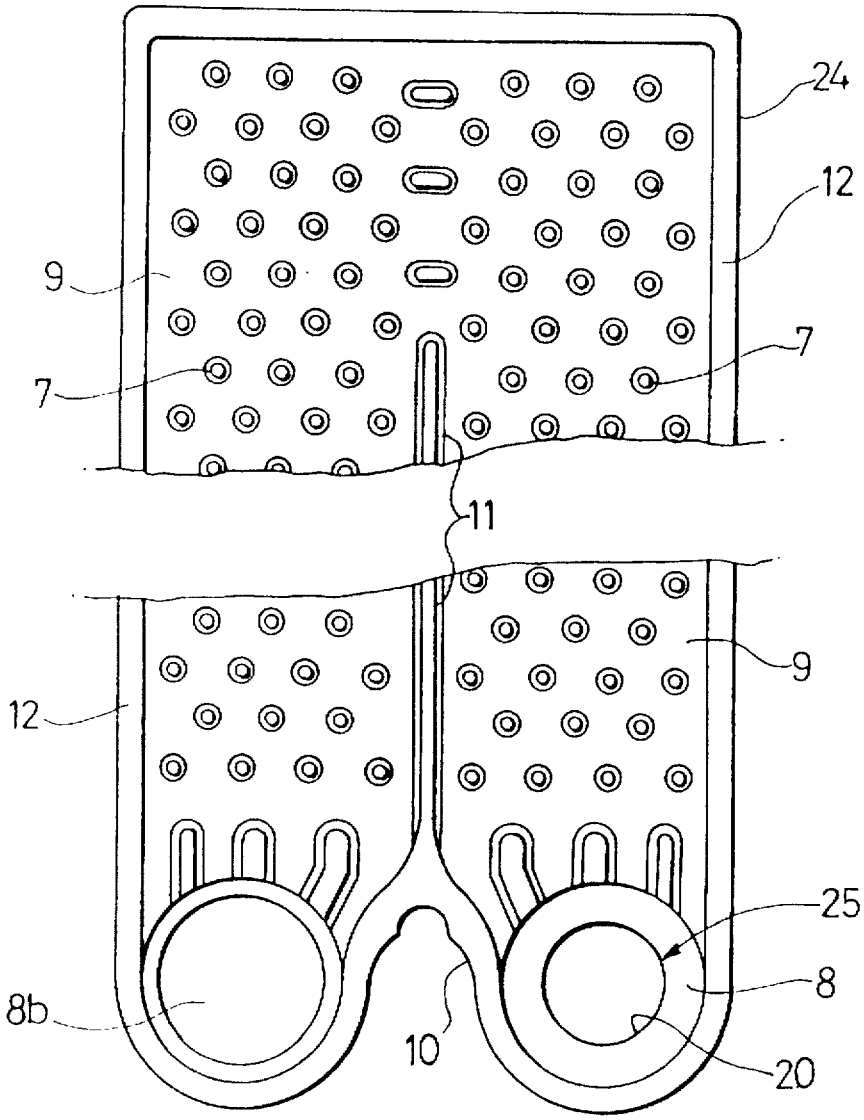

In addition, the tube element 3*d* is constituted by bonding a formed plate 23 or 24 that is provided with a distended portion for tank formation 8*b* that has no communicating hole formed as shown in FIG. 6 or FIG. 7 to the formed plate 6, shown in FIG. 3. In the tube element 3*d*, one of the tank components, i.e., the tank component 13*b* is blocked off with the distended tank portion 8*b* to constitute a blind tank component 13*b* and if the formed plate shown in FIG. 7 is employed, a constriction 25 achieved by reducing the diameter of the communicating hole 20 is formed in the other tank component, i.e., the tank component 13.

Thus, in the laminated heat exchanger 1, adjacent tube elements 3, 3*a*, 3*b*, 3*c* and 3*d* are abutted at their tank components 13, 13*a* and 13*b*, as shown in FIGS. 1 and 2. With this series of tank components thus abutted, two tanks, i.e., a first tank group 27 and a second tank group 28, are constituted in the direction of the lamination (the direction running perpendicular to the direction of airflow). In the first tank group 27, which includes the enlarged tank component 13*a*, all the tank components are in communication via the communicating holes 20 formed in the distended tank portions except for the blind tank component 13*b* of the tube element 3*d*, which is positioned approximately at the center in the direction of the lamination.

In other words, with the blind tank component 13*b*, the first tank group 27 is partitioned into two tank blocks, i.e., a first tank block α, which includes the enlarged tank component 13*a*, and a second tank block β which communicates with the outflow port 5. In addition, the second tank group 28, whose tank components are all in communication via the communicating holes 20 without partitioning, constitutes a third tank block γ.

As shown in FIGS. 1 and 2, a distribution plate 29 is bonded to the flat plate 15 at one end in the direction of the lamination. In this distribution plate 29, two bulging portions distend, i.e., a first bulging portion 30 and a second bulging portion 31 formed through press machining or the like, with the inflow port 4 formed at one end of the first bulging portion 30 and the outflow port 5 formed at the end of the second bulging portion 31 on the same side. By bonding this distribution plate 29 to the plate 15, an inflow passage 32 communicating with the inflow port 4, and an outflow passage 33 communicating with the outflow port 5 are formed between these plates. One end of the communicating pipe 35, whose other end is connected to the connecting hole 21, opens into the inflow passage 32 via the flat plate 15, and the outflow passage 33 communicates with the second tank block β via the flat plate 15. A coupling 36 for securing an expansion valve (not shown) is bonded to the inflow port 4 and the outflow port 5.

Thus, coolant that has flowed in through the inflow port 4 travels through the inflow passage 32 and the communicating pipe 35 to enter the enlarged tank portion 13*a*, becomes dispersed throughout the entire first tank block α and flows along the partitioning walls 11 through the U-turn passages 14 of the tube elements corresponding to the first tank block α (first pass). Then, it makes a U-turn above the partitioning walls 11 and travels downward (second pass) to reach the tanks on the opposite side (third tank block γ). After this, it moves horizontally to the remaining tube elements constituting the third tank block γ and flows along the partitioning walls 11 through the U-turn passages 14 of the remaining tube elements (third pass). Next, it travels downward after making the U-turn over the partitioning walls 11 (fourth pass), and is guided to the tank components constituting the second tank block β, finally flowing out through the outflow port 5 after traveling through the outflow passage 33. During this process, the heat of the coolant is communicated to the fins 2 while the coolant flows through the U-turn passages 14 constituting the first through fourth passes, so that heat exchange is performed with the air passing over the fins.

Figure 8A:
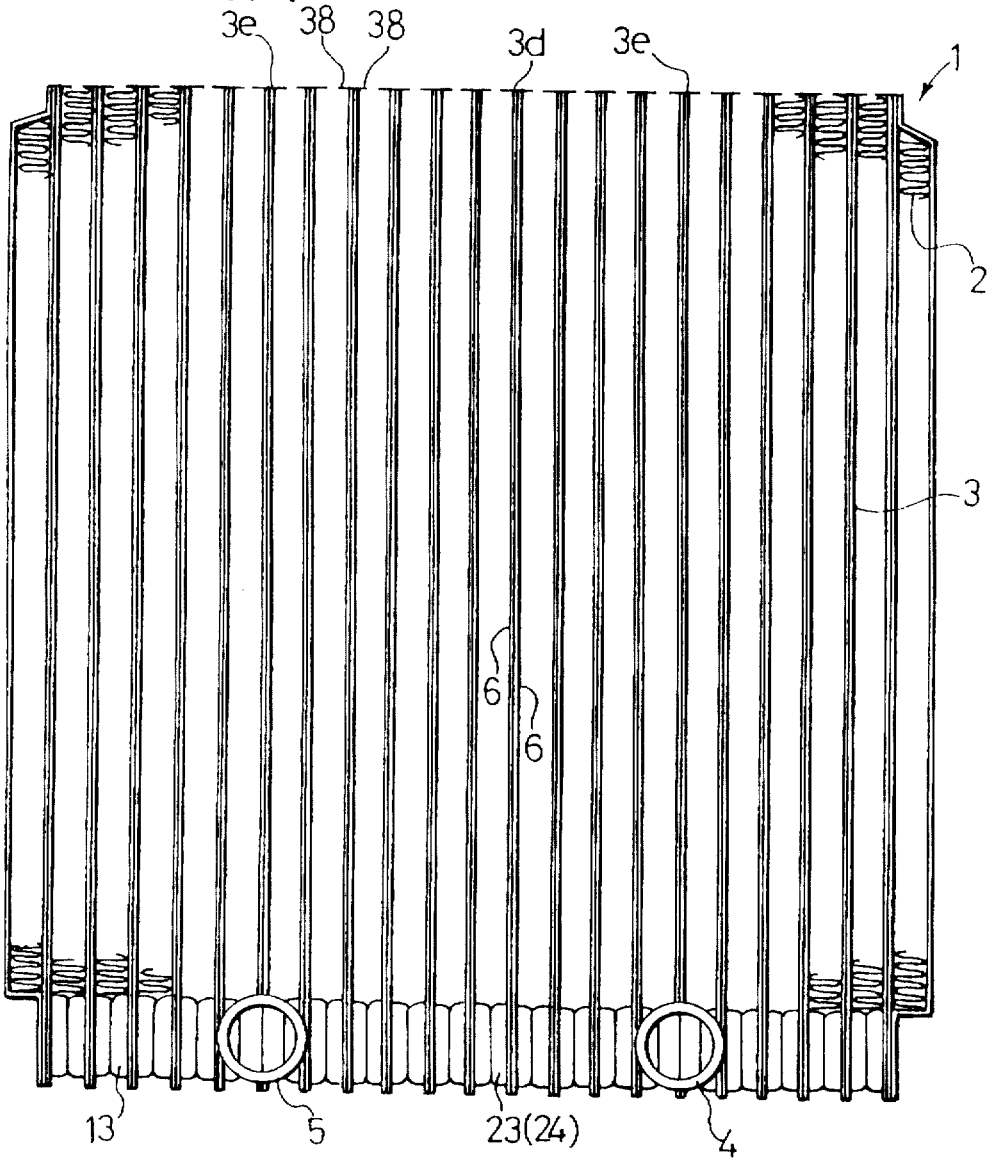
FIG. 8 shows another structural example of the laminated heat exchanger, with FIG. 8A showing its front view and FIG. 8B showing the laminated heat exchanger in FIG. 8A viewed from the bottom.
Figure 8B:
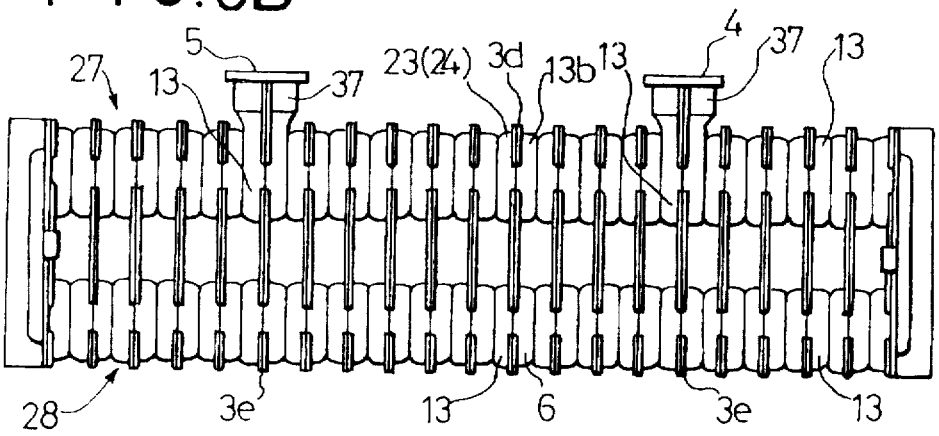

FIG. 8 shows another unilateral-tank type heat exchanger, which may be constituted by forming an inflow port 4 and an outflow port 5 by projecting and opening the tank components 13 of tube elements 3*e* and 3*e* located at specific positions in the individual areas (corresponding to the first tank block α and the second tank block β) in the first tank group 27 which is partitioned by the blind tank component 13*b* in the direction of airflow (the direction perpendicular to the direction of the lamination) without providing the distribution plate, the communication pipe or the enlarged tank component, as shown in the figure.

Figure 9A:
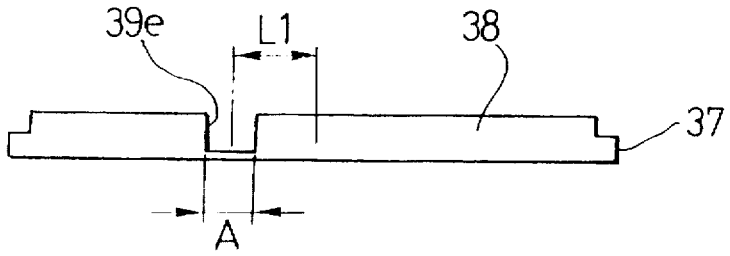
FIG. 9 shows the formed plate used in the tube element provided with the inflow/outflow ports employed in the laminated heat exchanger shown in FIG. 8, with FIG. 9A showing the formed plate in FIG. 9B viewed from above and FIG. 9B showing a front view.
Figure 9B:
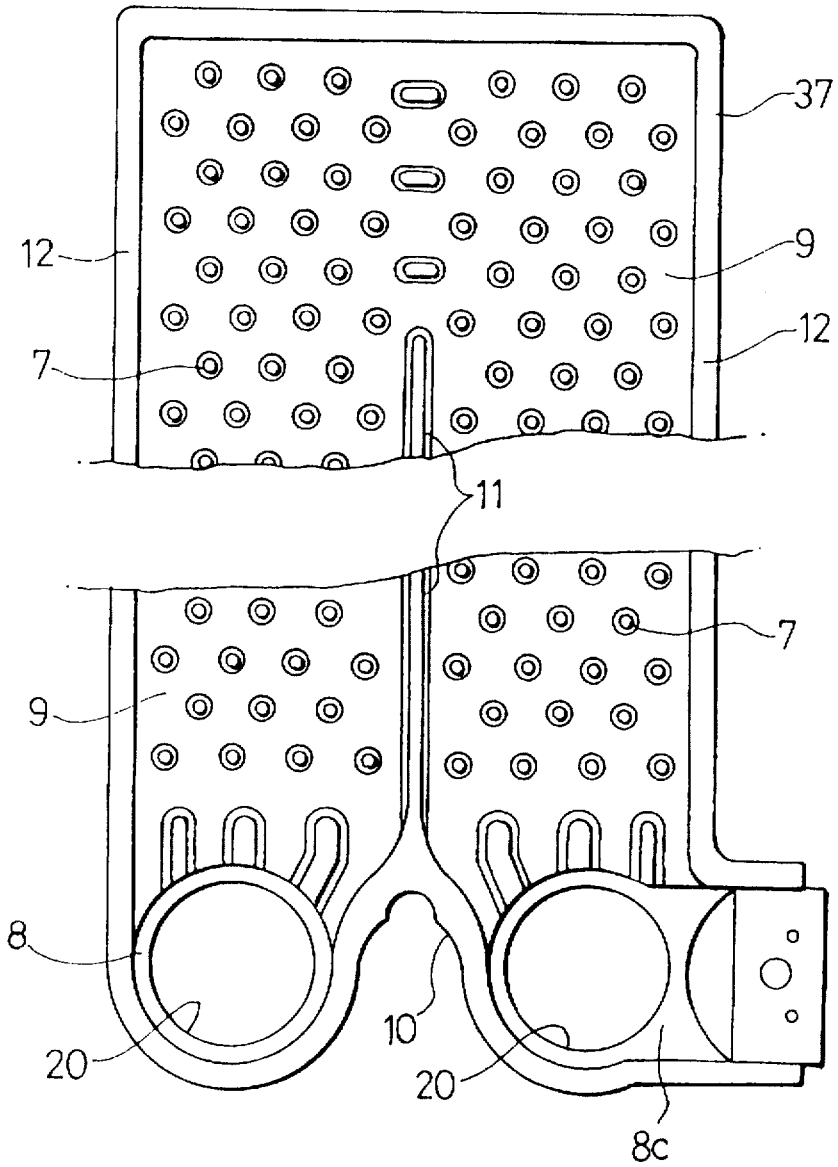

Each tube element 3*e* is constituted by bonding a formed plate 37 shown in FIG. 9 face-to-face with a formed plate that is symmetrical to the formed plate 37. In each of the formed plates, one of the distended tank portions, i.e., the distended tank portion 8*c* is made to project out and open away from the other distended tank portion, i.e. the distended tank portion 8 and, in each of the distended tank portions 8 and 8*a*, a communicating hole 20 is formed. Since the other structural aspects of this heat exchanger are basically identical to those of the previous embodiment, the same reference numbers are assigned to identical components and their explanations are omitted.

In the two types of laminated heat exchangers described above, in each formed plate a flange portion 38 that is bent toward the fin is formed as an integral part at one end on the side opposite from the tanks. These flange portions 38 face opposite each other over specific gaps without being abutted between the tube elements to ensure that the fins provided between the tube elements do not fall out in an assembled state before brazing. In addition, they are utilized to prevent erroneous assembly and also to allow a decision to be made as to whether or not specific tube elements are assembled at specific positions after assembly.

Namely, in the first laminated heat exchanger shown in FIGS. 1 and 2 of the two types of laminated heat exchangers described above, the tube elements except for those at the two ends, i.e., the tube elements provided in the middle of the lamination, are constituted by variously combining the formed plates shown in FIGS. 3~5 and the formed plates shown either in FIG. 6 or 7 whereas in the second laminated heat exchanger shown in FIG. 8, the tube elements except for those at the two ends, i.e., the tube elements provided in the middle of the lamination, are constituted by combining the formed plate shown in FIG. 3 with the formed plate shown in either FIG. 6 or 7 and also by combining the formed plate shown in FIG. 9 and the formed plate that is symmetrical to the formed plate shown in FIG. 9. Consequently, even when common parts are to be used in these two types of laminated heat exchangers, at least a total of 7 different types of formed plates are required.

Of those formed plates, the formed plates shown in FIGS. 4 and 5 and the formed plate shown in FIG. 9 and the one that is symmetrical to it always must maintain a relationship in which they form pairs in order to constitute a tube element provided with the enlarged tank component and the tube element provided with the inflow port and the outflow port. As far as differentiating them from the other tube elements is concerned, the pair of plates shown in FIGS. 4 and 5, and the pair constituted of the plate shown in FIG. 9 and the one that is symmetrical to it may each be handled as one type of plate. In order to facilitate this handling, the following identification marks are provided at the flange portion 38 of each formed plate.

Figure 4A:
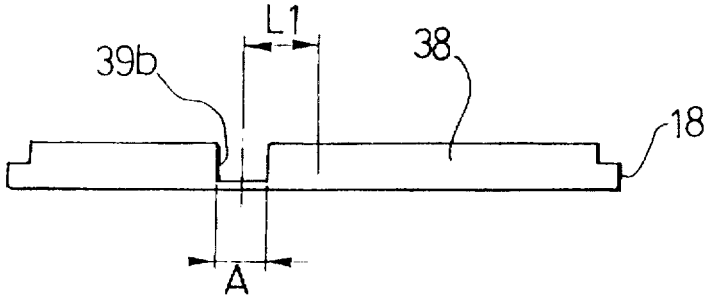
FIGS. 4 and 5 show formed plates which constitute the tube element provided with an enlarged tank component employed in the laminated heat exchanger shown in FIG. 1 with FIGS. 4A and 5A showing the corresponding formed plates in FIGS. 4B and 5B, respectively, viewed from above and FIGS. 4B and 5B showing front views of the corresponding formed plates.
Figure 4B:
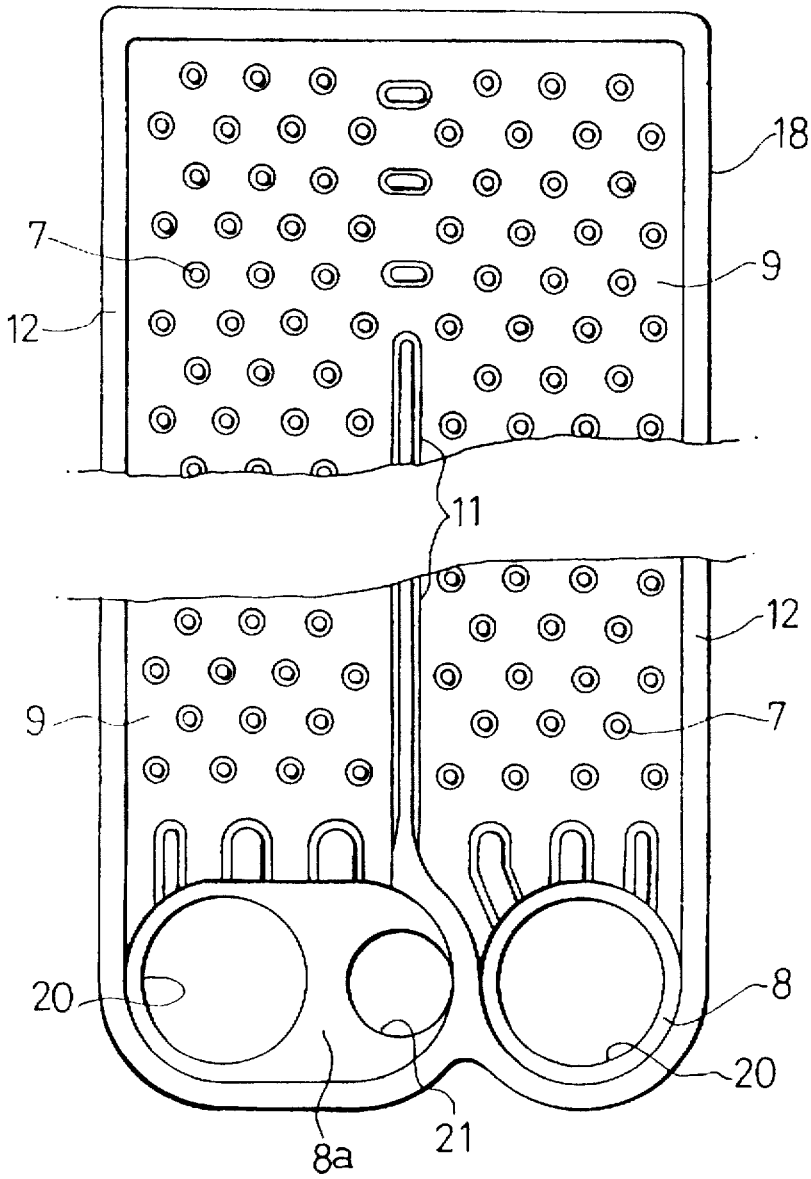
Figure 5A:
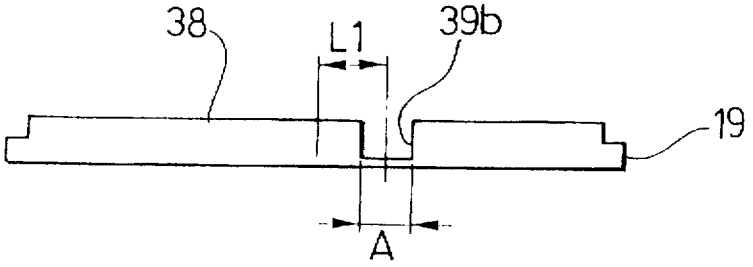
Figure 5B:
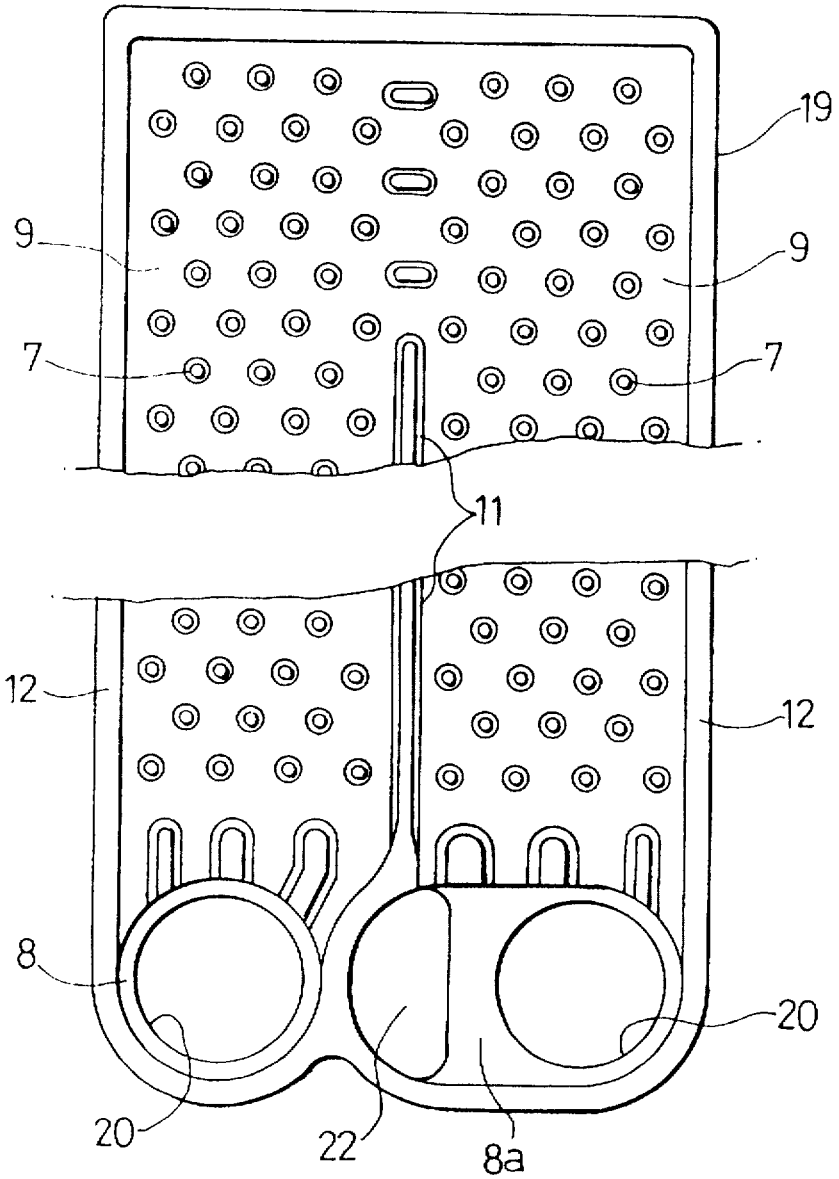

First, in the standard formed plate 6, shown in FIG. 3, a notch 39*a* with a specific width A is formed at the center of the flange portion 38 (on a line extending from the partitioning wall 11) as shown in FIG. 3A, and the formed plates 18 and 19 shown in FIGS. 4 and 5 are each provided with a notch 39*b* with the specific width A at a position which is closer to the enlarged distended tank portion 8*a* relative to the center of the flange portion 38 by a distance L1, as shown in FIGS. 4A and 5A. As for the formed plate 23 shown in FIG. 6, a notch 39*c* with the specific width B which is larger than A is formed at a position closer to the distended tank portion 8*b* relative to the center of the flange portion 38 by a distance L2 (L2>L1), as shown in FIG. 6A and, in the case of the formed plate 24, shown in FIG. 7, a notch 39*d* with the specific width B is formed at a position closer to the constriction 25 relative to the center of the flange portion 38 by the distance L2, as shown in FIG. 7A. In either the formed plate 37 shown in FIG. 9 or the formed plate which is symmetrical to it, a notch 39*e* with a specific width A is formed at a position that is offset toward the opposite side from the distended tank portion 8*c* relative to the center of the flange portion 38 by the distance L1, as shown in FIG. 9A.

Figure 10:
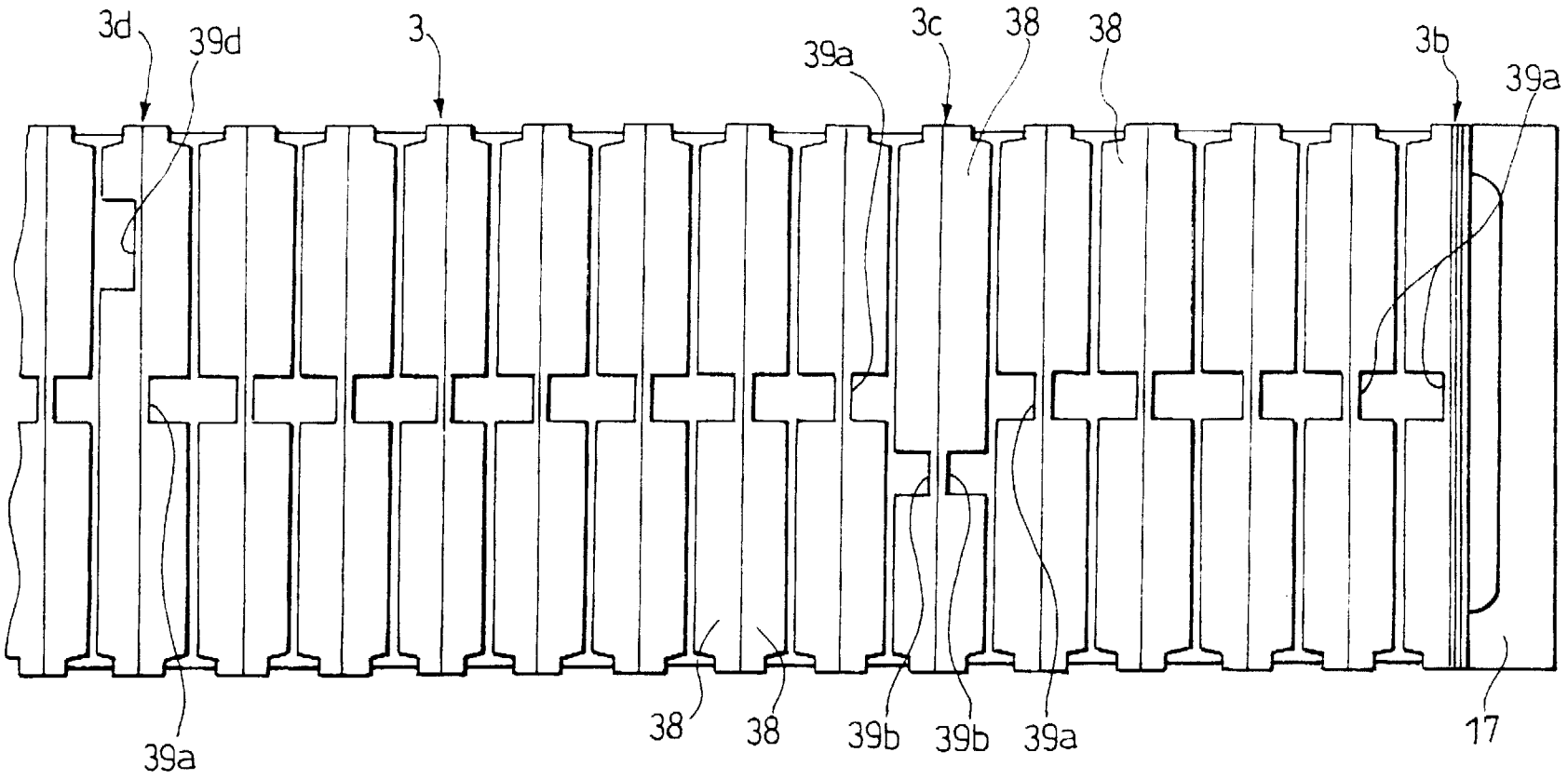
FIG. 10 shows a portion of the laminated heat exchanger in FIG. 1 viewed from above.
Figure 11:
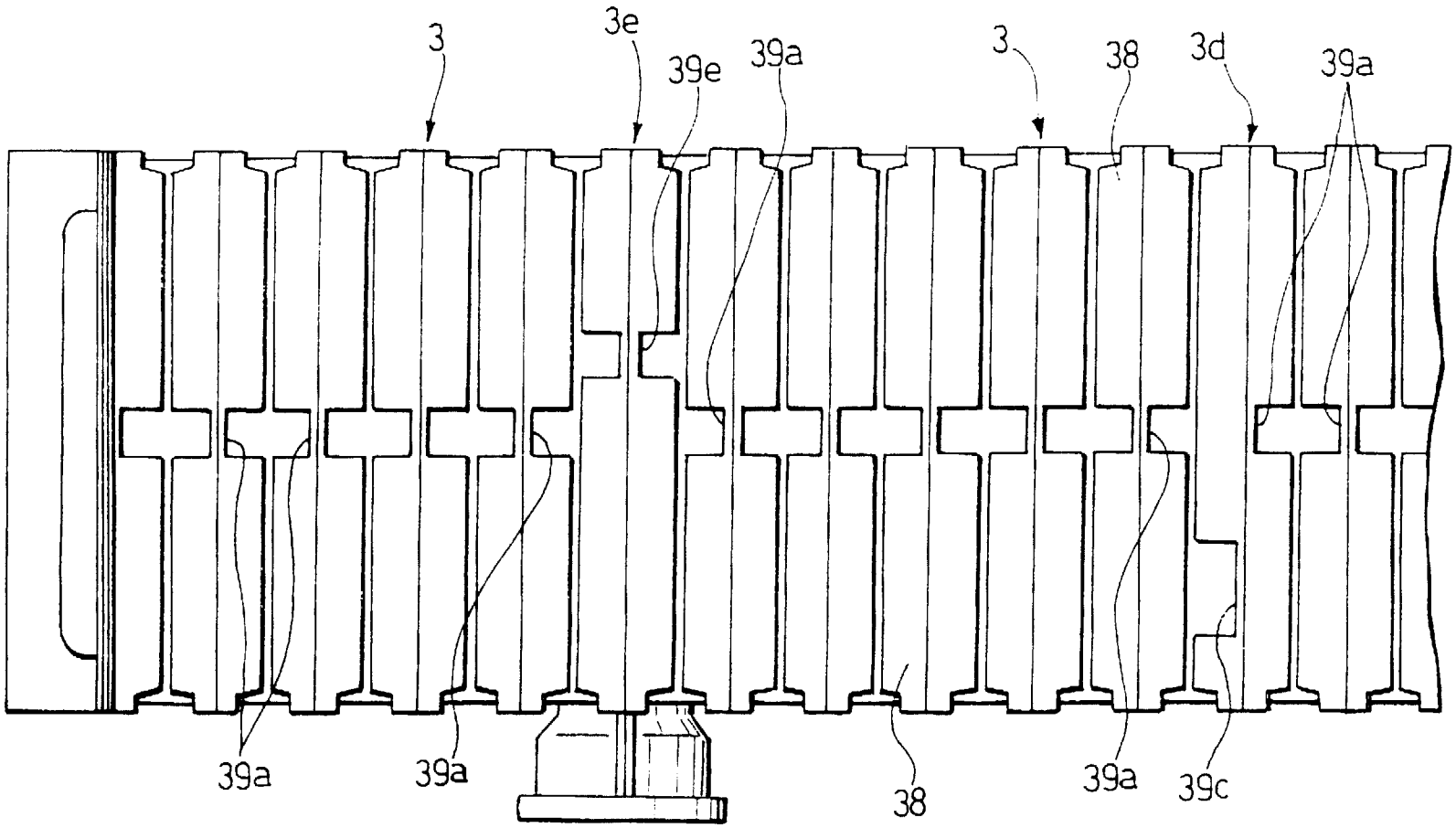
FIG. 11 shows a portion of the laminated heat exchanger in FIG. 8 viewed from above.

As a result, with either of the laminated heat exchangers shown in FIGS. 1 and 8 constituted by laminating the tube elements (formed plates) described above, if the heat exchanger is used with the flange portions 38 turned downward, condensed water is caused to drip down through the gaps between the flange portions to achieve good drainage and since the notches 39*a*~39*e* are formed at varying positions in the direction of the width of the core main body along the direction of airflow in the different types of tube elements (formed plates), the assembled heat exchanger viewed from the flange side is as shown in FIG. 10 in the case of the heat exchanger in FIG. 1 and as shown in FIG. 11 in the case of the heat exchanger in FIG. 8, resulting in the identification of the various types of formed plates facilitated with the shifting of the notches 39*a*~39*e*.

Thus, if the formed plates are assembled in the wrong order, a specific formed plate will not be positioned at the designated lamination position and the arrangement pattern of the notches will not be as shown in FIG. 10 or FIG. 11, making it possible to detect an error in the arrangement pattern easily even through visual inspection. If the arrangement pattern is inspected using a detection device, the arrangement can be checked with a particularly high degree of accuracy.

Figure 12B:
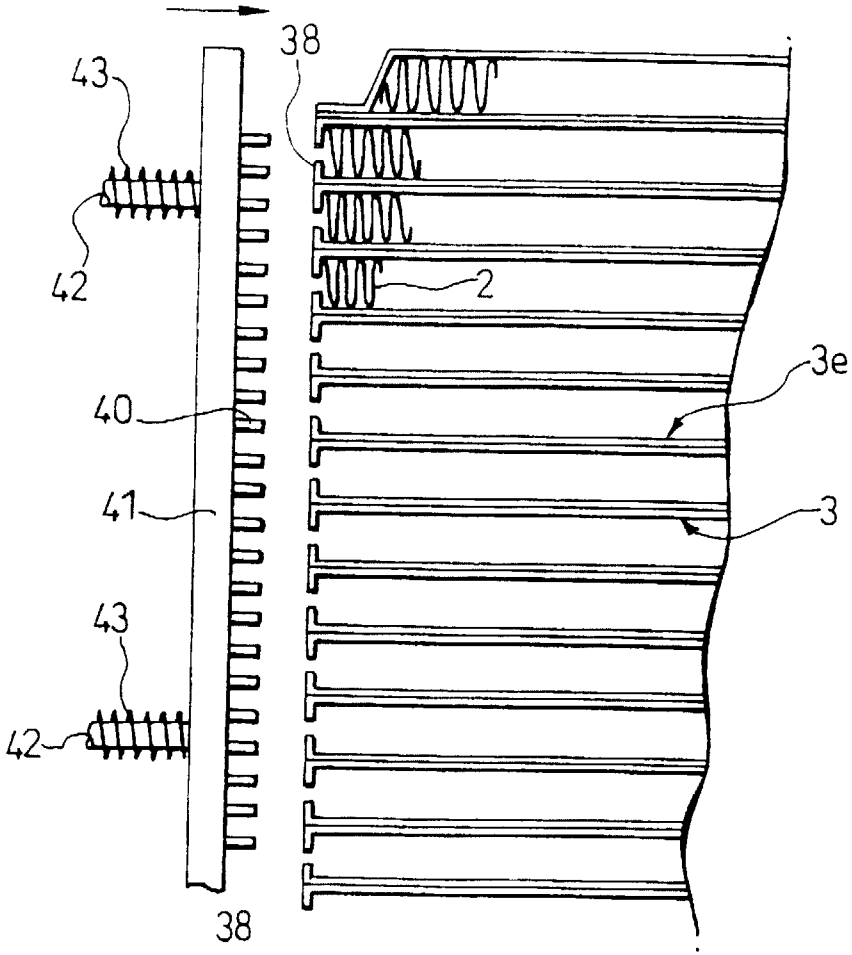
FIGS. 12A and 12B illustrate a mechanical method for inspecting the arrangement of the tube elements (formed plates)
Figure 12A:
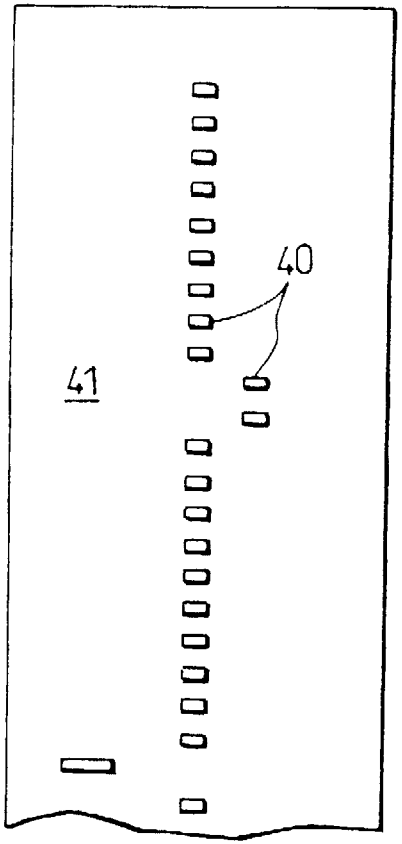

The method of inspection to be employed in this instance may be either mechanical or a method employing image processing. If a mechanical method is to be employed, projections 40 that fit the notches should be provided in a specifically arranged pattern at a mobile block 41, as shown in FIG. 12. By moving this mobile block 41 over a specific distance in the direction indicated with the arrow at the end surface of the heat exchanger toward the flange portions, it is decided that the heat exchanger is assembled in a correct arrangement if all the projections 40 fit in the notches of the corresponding flange portions 38. In addition, if even one projection 40 does not fit in the corresponding notch, the projection 40 will contact the flange portion 38 hindering the further advance of the mobile block 41, and in order to take advantage of this, the method may include a spring 43 provided at a support portion 42 of the mobile block 41 which is pushed back in such a case, with an alarm sounded via a sensor or a switch that recognizes this pushed back state to decide that the formed plates are erroneously assembled.

Figure 13:
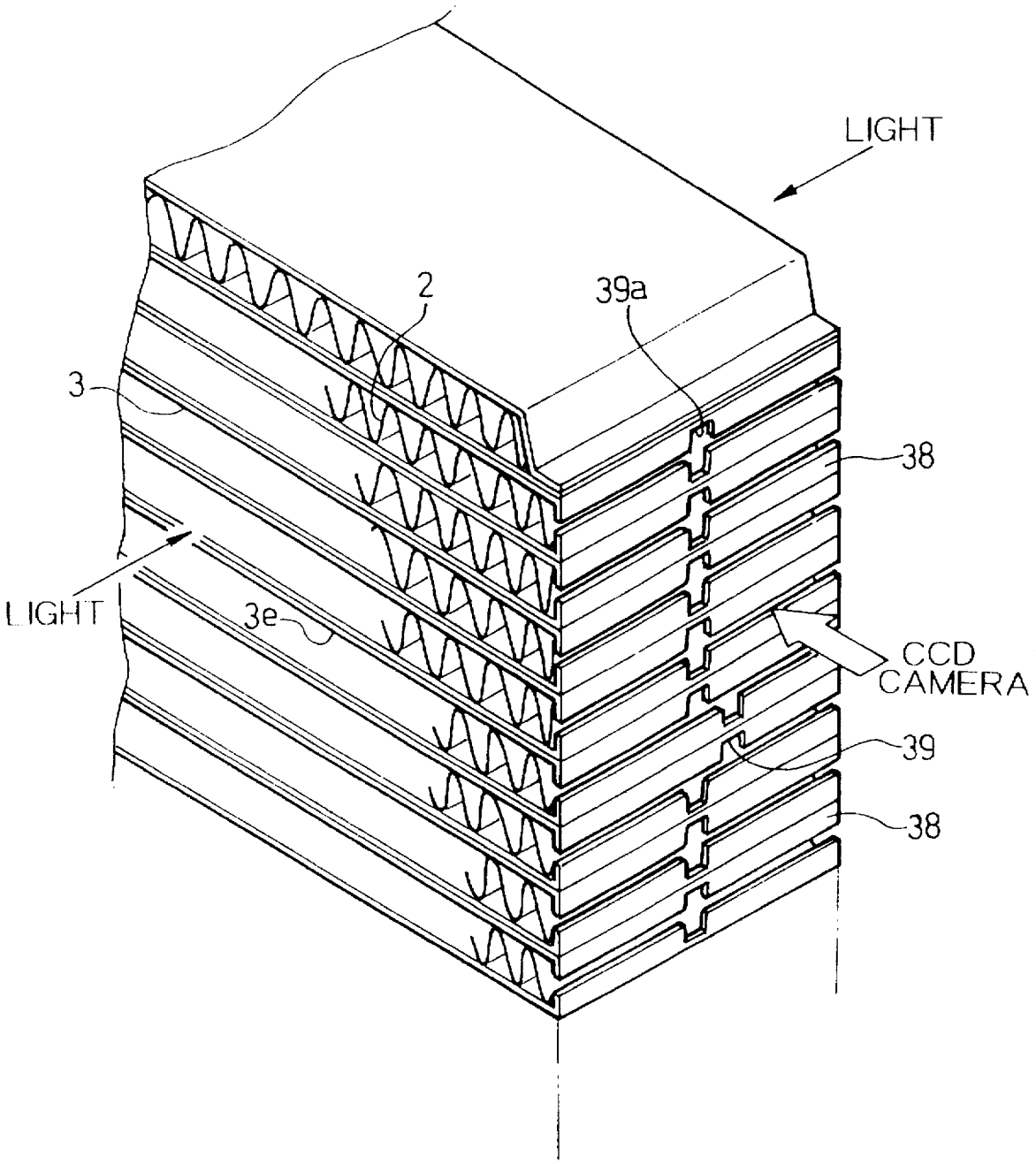
FIG. 13 illustrates a method for inspecting the arrangement of the tube elements (tube elements) through image processing.

In addition, in detection through image processing, as shown in FIG. 13, for instance, light may be irradiated along the direction of airflow on the areas between the tube elements to detect light being transmitted through the gaps between the flange portions 38 or the notches (39*a* and the like) with a CCD camera so that a decision can be made as to whether or not the correct arrangement has been achieved by comparing the pattern made by the transmitted light against a specific pattern that has been stored in memory in advance.

In either method, with the heat exchangers described above, since there is only one notch formed in each flange portion, the likelihood of erroneous judgment being made can be reduced even in the case of visual inspection as well as when a detection device is employed. In addition, during the assembly work, the likelihood of erroneous assembly is reduced. Furthermore, since a notch of any size can be formed at any position in each flange portion 38, even when many different types of formed plates are required, sufficient space is available to accommodate the notches necessary for identification of those formed plates and, by varying the positions and the widths of the notches greatly among different types of formed plates, the identification can be made easily.

As has been explained, according to the present invention, since the notch is formed of a different size and at a different position in the flange portion of the formed plate on the side opposite from the tank, depending upon the type of formed plate, as long as the formed plates are assembled by assuring that the notches achieve a specific arrangement, tube elements can be assembled at their designated positions. Moreover, since a notch can be formed at any position and of any size in each flange portion, many different types of formed plates can be differentiated from one another even without providing a plurality of notches in each flange portion. As a result, visual inspection is facilitated and the likelihood of erroneous judgments being made in inspection of the tube element arrangement using an identification device can be also reduced.

What is claimed is:

1. A laminated heat exchanger comprising:

a core main body comprising a plurality of tube elements laminated over a plurality of levels with fins provided between said tube elements;

wherein each of said tube elements comprises two formed plates bonded face-to-face;

wherein each of said tube elements has tanks provided at a first end thereof, and a U-turn passage having two end portions respectively communicating with said tanks;

wherein, at a second end of each of said tube elements, flange portions project outwardly toward respective ones of said fins, said flange portions of adjacent tube elements facing opposite each other and being separated from each other by a gap;

wherein each of said flange portions has one, and only one, notch formed in a center portion thereof; and wherein said tube elements comprise a plurality of different types of tube elements, and said notches are located in different positions in said center portions of said flange portions, along a widthwise direction of said core main body perpendicular to a lamination direction thereof, for said different types of said tube elements, respectively.

2. A laminated heat exchanger according to claim 1, wherein at least one of said notches of said flange portions of said different types of tube elements is of a different size than other of said notches.

3. A laminated heat exchanger according to claim 1, wherein a plurality of said notches of said flange portions of said different types of tube elements, respectively, are of equal size.

4. A laminated heat exchanger according to claim 1, wherein all of said notches of said flange portions of said different types of tube elements, respectively, are the same in shape.

5. A method for inspecting a laminated heat exchanger comprising a core main body comprising a plurality of tube elements laminated over a plurality of levels with fins provided between said tube elements; wherein each of said tube elements comprises two formed plates bonded face-to-face; wherein each of said tube elements has tanks provided at a first end thereof, and a U-turn passage having two end portions respectively communicating with said tanks; wherein, at a second end of each of said tube elements, flange portions project outwardly toward respective ones of said fins, said flange portions of adjacent tube elements facing opposite each other and being separated from each other by a gap; wherein each of said flange portions has a notch formed in a center portion thereof; and wherein said tube elements comprise a plurality of different types of tube elements, and said notches are located in different positions, along a widthwise direction of said core main body perpendicular to a lamination direction thereof, for said different types of said tube elements, respectively, and wherein said method comprises:

providing a mobile block having projections, in a predetermined arrangement, that fit into said notches, a support portion, and a spring provided around said support portion;

advancing said mobile block toward said flange portions from a position facing said flange portions; and recognizing erroneous lamination assembly of said tube elements by detecting a state in which said projections are not all inserted in said notches and said spring is pushed back.

6. A method for inspecting a laminated heat exchanger comprising a core main body comprising a plurality of tube elements laminated over a plurality of levels with fins provided between said tube elements; wherein each of said tube elements comprises two formed plates bonded face-to-face; wherein each of said tube elements has tanks provided at a first end thereof, and a U-turn passage having two end portions respectively communicating with said tanks; wherein, at a second end of each of said tube elements, flange portions project outwardly toward respective ones of said fins, said flange portions of adjacent tube elements facing opposite each other and being separated from each other by a gap; wherein each of said flange portions has a notch formed in a center portion thereof; and wherein said tube elements comprise a plurality of different types of tube elements, and said notches are located in different positions, along a widthwise direction of said core main body perpendicular to a lamination direction thereof, for said different types of said tube elements, respectively, and wherein said method comprises:

providing said laminated heat exchanger in an inspection space with a surface thereof opposite a CCD camera set at an end of said heat exchanger facing said flange portions;

irradiating light on areas between said tube elements; and determining a presence or absence of an erroneous state of assembly of lamination by detecting light being transmitted through at least one of said gaps and said notches in said flange portions by said CCD camera, and comparing a resulting pattern against a pattern stored in memory.

7. A laminated heat exchanger comprising:

a plurality of tube elements and a plurality of fins provided between adjacent tube elements;

wherein each of said tube elements is constituted of two formed plates that are bonded face-to-face, with a pair of tank portions formed at a first end of each of said tube elements, and a U-turn passage portion communicating between said pair of tank portions;

wherein a communicating pipe passes through an area formed between a plurality of said pairs of tank portions;

wherein a first tank group and a second tank group are formed with tank portions of said plurality of tube elements, with said first tank group divided into an intake side sub block and an outlet side sub block with a boundary thereof constituted by a partition provided at an approximate center in a direction of the lamination and said second tank group constituting a single block without being divided by a partition;

wherein an intake portion and an outlet portion communicating with said intake side sub block and said outlet side sub block are formed at one end of said laminated heat exchanger in said direction of the lamination, with one of said intake side sub block and said outlet side sub block communicating with one of said intake portion and said outlet portion via said communicating pipe and the other of said intake side sub block and said outlet side sub block communicating with the other of said intake portion and said outlet portion;

wherein flange portions projecting out toward said fins from said formed plates are provided at second ends of said tube elements, with said flange portions facing opposite each other between said tube elements and facing opposite each other over a gap, and with notches formed in said flange portions; and wherein said notches are formed with positions thereof shifted in a direction of airflow of said laminated heat exchanger among formed plates provided with said partition, formed plates constituting tube elements provided with tank portions connected to said communicating pipe and other formed plates.

8. A laminated heat exchanger according to claim 7, wherein:

in said formed plates provided with said partition, notch width is made larger than notch width in other of said formed plates.

9. A laminated heat exchanger according to claim 7, wherein:

said notch in said formed plate provided with said partition and said notches formed in said formed plates of said tube elements connected to said communicating pipe are placed at opposite positions, in said direction of airflow, relative to a portion of said notches formed in said other formed plates.

10. A laminated heat exchanger according to claim 7, wherein:

said notches formed in said other formed plates are formed at an approximate center in said direction of airflow of said laminated heat exchanger.

11. A method for inspecting a laminated heat exchanger according to claim 7, said method comprising:

providing a mobile block having projections, in a predetermined arrangement, that fit into said notches, a support portion, and a spring provided around said support portion;

advancing said mobile block toward said flange portions from a position facing said flange portions; and recognizing erroneous lamination assembly of said tube elements by detecting a state in which said projections are not all inserted in said notches and said spring is pushed back.

12. A method for inspecting a laminated heat exchanger according to claim 7, said method comprising:

providing said laminated heat exchanger in an inspection space with a surface thereof opposite a CCD camera set at an end of said heat exchanger facing said flange portions;

irradiating light on areas between said tube elements; and determining a presence or absence of an erroneous state of assembly of lamination by detecting light being transmitted through at least one of said gaps and said notches in said flange portions by said CCD camera, and comparing a resulting pattern against a pattern stored in memory.

13. A laminated heat exchanger comprising:

a plurality of tube elements and a plurality of fins provided between adjacent tube elements;

wherein each of said tube elements is constituted of two formed plates that are bonded face-to-face, with a pair of tank portions formed at a first end of each of said tube elements, and a U-turn passage portion communicating between said pair of tank portions; and wherein a first tank group and a second tank group are formed with tank portions of said plurality of tube elements, with said first tank group divided into an intake side sub block and an outlet side sub block with a boundary thereof constituted by a partition provided at an approximate center in a direction of the lamination and said second tank group constituting a single block without being divided by a partition;

wherein an intake portion communicating with said intake side sub block projects out from a tank portion of a specific tube element of said intake side sub block, and an outlet portion communicating with said outlet side sub block projects out from a tank portion of a specific tube element of said outlet side sub block;

wherein flange portions projecting out toward said fins from said formed plates are provided at second ends of said tube elements, with said flange portions facing opposite each other between said tube elements and facing opposite each other over a gap, and with notches formed in said flange portions; and wherein said notches are formed with positions thereof shifted in a direction of airflow of said laminated heat exchanger among formed plates provided with said partition, formed plates constituting tube elements at which said intake portions and said outlet portion are formed and other formed plates.

14. A laminated heat exchanger according to claim 13, wherein:

in said formed plates provided with said partition, notch width is made larger than notch width in other of said formed plates.

15. A laminated heat exchanger according to claim 13, wherein:

said notch in said formed plate provided with said partition and said notches formed in said formed plates constituting said tube elements at which said intake portion and said outlet portion are formed are placed at opposite positions, in said direction of airflow, relative to a position of a notch formed in said other formed plates.

16. A laminated heat exchanger according to claim 13, wherein:

said notches formed in said other formed plates are formed at an approximate center in said direction of airflow of said laminated heat exchanger.

17. A method for inspecting a laminated heat exchanger according to claim 13, said method comprising:

providing a mobile block having projections, in a predetermined arrangement, that fit into said notches, a support portion, and a spring provided around said support portion;

advancing said mobile block toward said flange portions from a position facing said flange portions; and recognizing erroneous lamination assembly of said tube elements by detecting a state in which said projections are not all inserted in said notches and said spring is pushed back.

18. A method for inspecting a laminated heat exchanger according to claim 13, said method comprising:

providing said laminated heat exchanger in an inspection space with a surface thereof opposite a CCD camera set at an end of said heat exchanger facing said flange portions;

irradiating light on areas between said tube elements; and determining a presence or absence of an erroneous state of assembly of lamination by detecting light being transmitted through at least one of said gaps and said notches in said flange portions by said CCD camera, and comparing a resulting pattern against a pattern stored in memory.

* * * * *